US009241205B2

(12) United States Patent
Fukuoka et al.

(10) Patent No.: US 9,241,205 B2
(45) Date of Patent: Jan. 19, 2016

(54) VIBRATION DEVICE, SOUND GENERATOR, SPEAKER SYSTEM, AND ELECTRONIC DEVICE

(71) Applicant: KYOCERA Corporation, Kyoto-shi, Kyoto (JP)

(72) Inventors: Shuichi Fukuoka, Kirishima (JP); Noriyuki Kushima, Kirishima (JP); Hiroshi Ninomiya, Kirishima (JP); Takeshi Hirayama, Kirishima (JP)

(73) Assignee: Kyocera Corporation, Kyoto-Shi, Kyoto (JP)

( * ) Notice: Subject to any disclaimer, the term of this patent is extended or adjusted under 35 U.S.C. 154(b) by 0 days.

(21) Appl. No.: 14/369,086

(22) PCT Filed: Nov. 29, 2012

(86) PCT No.: PCT/JP2012/080901

§ 371 (c)(1),
(2) Date: Jun. 26, 2014

(87) PCT Pub. No.: WO2013/099511

PCT Pub. Date: Jul. 4, 2013

(65) Prior Publication Data

US 2015/0010174 A1 Jan. 8, 2015

(30) Foreign Application Priority Data

Dec. 27, 2011 (JP) ..... 2011-285759

(51) Int. Cl.

| | |
|---|---|
| ***H04R 1/42*** | (2006.01) |
| ***H04R 1/00*** | (2006.01) |
| ***H04R 7/04*** | (2006.01) |
| ***H04R 19/02*** | (2006.01) |
| *H04R 1/26* | (2006.01) |

(52) U.S. Cl.
CPC ..... *H04R 1/00* (2013.01); *H04R 7/045* (2013.01); *H04R 19/02* (2013.01); *H04R 1/26* (2013.01); *H04R 2420/07* (2013.01); *H04R 2499/15* (2013.01)

(58) Field of Classification Search
CPC ..... H04R 1/42; H04R 1/02; H04R 1/025; H04R 1/026; H04R 9/00; H04R 9/025; H04R 9/027; H04R 7/00; H04R 2207/00
USPC ..... 381/162, 386, 396, 417–418, 423–424
See application file for complete search history.

(56) References Cited

U.S. PATENT DOCUMENTS

| | | | | |
|---|---|---|---|---|
| 8,526,659 | B2 * | 9/2013 | Nageno et al. | 381/396 |
| 2009/0247810 | A1 * | 10/2009 | Parker et al. | 600/25 |

FOREIGN PATENT DOCUMENTS

| | | | |
|---|---|---|---|
| JP | 52-045923 | A | 4/1977 |
| JP | 57-128299 | U | 8/1982 |
| JP | 62-3192 | U | 1/1987 |
| JP | 2004-023436 | A | 1/2004 |
| JP | 2010-177867 | A | 8/2010 |

OTHER PUBLICATIONS

International Search Report, PCT/JP2012/080901, Jan. 7, 2013, 2 pgs.

* cited by examiner

*Primary Examiner* — Suhan Ni
(74) *Attorney, Agent, or Firm* — Volpe and Koenig, P.C.

(57) ABSTRACT

A vibration device includes a first frame member, a first vibration body, a second frame member, a second vibration body, and an exciter. The first vibration body is provided in an inner region of the first frame member. The second frame member is attached to the first vibration body with a spacing from the first frame member. The second vibration body is provided in an inner region of the second frame member with a spacing from the first vibration body. The exciter is attached to the second vibration body.

10 Claims, 7 Drawing Sheets

VIBRATION DEVICE, SOUND GENERATOR, SPEAKER SYSTEM, AND ELECTRONIC DEVICE

TECHNICAL FIELD

The present invention relates to a vibration device, an acoustic generator, a speaker system, and an electronic apparatus.

BACKGROUND ART

Speakers that include a diaphragm and a piezoelectric element attached to the diaphragm have thus far been known (refer to Patent Literature 1, for example).

CITATION LIST

Patent Literature

Patent Literature 1: Japanese Unexamined Patent Publication JP-A 2004-23436

SUMMARY OF INVENTION

Technical Problem

With the conventional speakers, however, it is difficult to gain a high acoustic pressure especially in a low frequency range, and hence it is difficult to generate a sound having a high acoustic pressure over a wide frequency range.

The present invention has been accomplished in view of the foregoing drawback, and provides a vibration device capable of generating a sound having a high acoustic pressure over a wide frequency range, and an acoustic generator, a speaker system, and an electronic apparatus incorporated with the vibration device.

Solution to Problem

The present invention provides a vibration device including a first frame member, a first vibration body provided in an inner region of the first frame member, a second frame member attached to the first vibration body with a spacing from the first frame member, a second vibration body provided in an inner region of the second frame member with a spacing from the first vibration body, and an exciter attached to the second vibration body.

The present invention also provides an acoustic generator including at least a speaker, and a support member to which the speaker is attached. The speaker includes the foregoing oscillator.

The present invention also provides a speaker system including at least a low range speaker, at least a high range speaker, and a support member that supports the low range speaker and the high range speaker. At least one of the low range speaker and the high range speaker includes the foregoing oscillator.

The present invention further provides an electronic apparatus including at least a speaker, a support member to which the speaker is attached, and an electronic circuit connected to the speaker. The speaker includes the foregoing oscillator, and the electronic apparatus is configured to generate a sound from the speaker.

Advantageous Effects of Invention

The vibration device, the acoustic generator, the speaker system, and the electronic apparatus according to the present invention are capable of generating a sound having a high acoustic pressure over a wide frequency range.

DESCRIPTION OF EMBODIMENTS

Hereafter, the respective embodiments of a vibration device, an acoustic generator, a speaker system, and an electronic apparatus according to the present invention will be described in detail, with reference to the accompanying drawings.

First Embodiment

Figure 1:
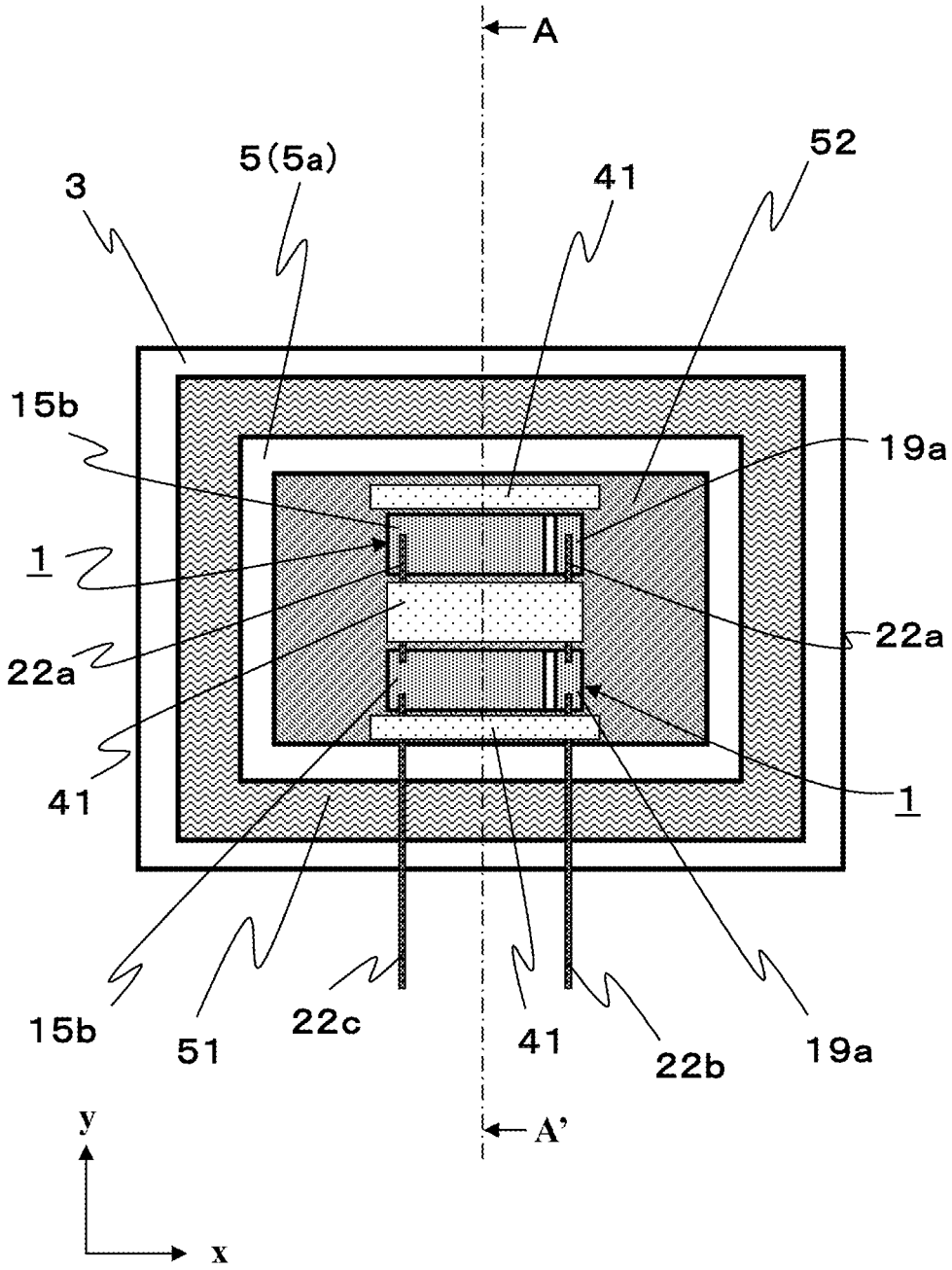
FIG. 1 is a schematic plan view showing a vibration device according to a first embodiment of the present invention.
Figure 2:
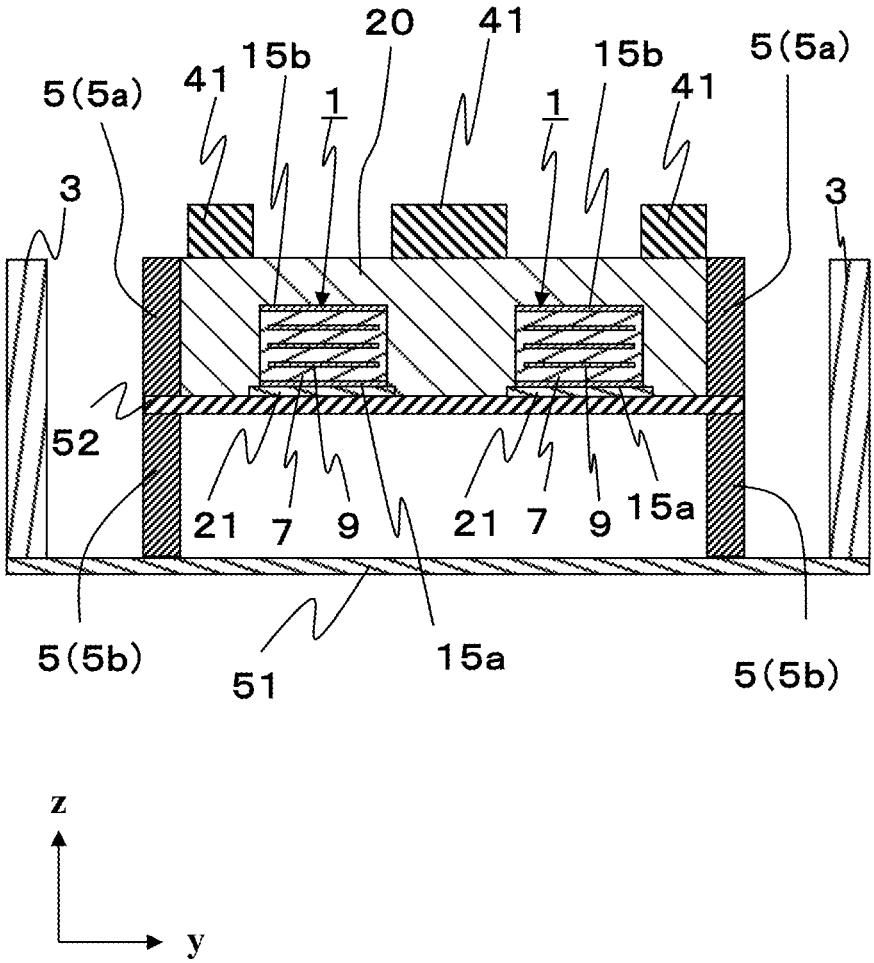
FIG. 2 is a cross-sectional view taken along a line A-A' in FIG. 1.

FIG. 1 is a schematic plan view showing a vibration device according to a first embodiment of the present invention. FIG. 2 is a cross-sectional view taken along a line A-A' in FIG. 1. For the sake of visual clarity, a resin layer 20 is excluded from FIG. 1, and FIG. 2 is illustrated in an enlarged scale in a thickness direction of the vibration device (z-axis direction in FIG. 2).

The vibration device according to this embodiment includes, as shown in FIG. 1 and FIG. 2, a plurality of exciters 1, a first vibration body 51, a second vibration body 52, a first frame member 3, a second frame member 5, a resin layer 20, leads 22*a*, 22*b*, 22*c*, and a plurality of load members 41.

The first frame member 3 has a rectangular frame shape. Although the material and the thickness of the first frame member 3 are not specifically limited, it is preferable to employ a material that is less deformable than the first vibration body 51. For example, a hard resin, a plastic, an engineering plastic, a metal, or a ceramic may be employed to form the first frame member 3. In particular, a stainless steel having a thickness of 100 to 1000 μm may be preferably employed. In addition, the shape of the first frame member 3 is not limited to rectangular, but may be, for example, circular or a diamond shape.

Preferably, the first vibration body 51 may be formed of a material having a flat shape, such as a film shape or a plate shape. In this embodiment, the first vibration body 51 is formed in a film shape, and has the rectangular peripheral portion attached to the first frame member 3 via an adhesive, under a tension applied thereto in a plane direction. Thus, the first vibration body 51 is provided over the entirety of the inner region of the first frame member 3.

It is preferable that the first vibration body 51 is easy to deform yet strong. Examples of such a material include resin materials such as low-density polyethylene and soft polyvinyl chloride, and rubber materials such as urethane rubber, silicone rubber, and acrylic rubber. In particular, a porous rubber (foamed rubber) formed of a rubber material such as urethane rubber, silicone rubber, or polyethylene rubber may be preferably employed. Above all, the urethane foam may be preferably employed. A preferable thickness range of the first vibration body 51 is, for example, 0.1 mm to 1 mm.

The second frame member 5 is attached to a central region of the first vibration body 51, with a spacing from the first frame member 3. The second frame member 5 has a rectangular frame shape, and is smaller in outer shape than the inner size of the first frame member 3. The second frame member 5 is composed of a pair of frame members 5*a*, 5*b* having the same shape. The frame members 5*a*, 5*b* are each formed in a rectangular frame shape. The frame members 5*a*, 5*b* holds the outer periphery of the second vibration body 52 therebetween, thus to fix the second vibration body 52 with a tension applied thereto in a plane direction. The frame members 5*a*, 5*b* may be formed of a stainless steel having a thickness 100 to 1000 μm, for example. However, the material of the frame members 5*a*, 5*b* is not limited to the stainless steel, but may be any material that is less deformable than the second vibration body 52 and the resin layer 20, such as a hard resin, a plastic, an engineering plastic, a metal, or a ceramic. The thickness of the frame members 5*a*, 5*b* is not specifically limited, either. In addition, the shape of the frame members 5*a*, 5*b* is not limited to rectangular, but may be, for example, circular or a diamond shape.

Preferably, the second vibration body 52 may be formed of a material having a flat shape, such as a film shape or a plate shape. In this embodiment, the second vibration body 52 is formed in a film shape, and provided over the entirety of the inner region of the second frame member 5, with a spacing from the first vibration body 51. The second vibration body 52 has the overall periphery of the rectangular shape held between the frame members 5*a*, 5*b* under a tension applied thereto in a plane direction, thus to be vibratably supported by the frame members 5*a*, 5*b*. The second vibration body 52 has a thickness of, for example, 10 to 200 μm. The second vibration body 52 may be formed of a resin such as polyethylene, a polyimide resin, polypropylene, or polystyrene, or a paper formed of pulp or fiber. Such materials are appropriate for minimizing a peak dip in the vibration characteristic.

The exciters 1 each include upper and lower main surfaces of a rectangular plate shape, one of which is bonded to one of the main surfaces of the second vibration body 52 with an adhesive. To be more detailed, a pair of exciters 1 are aligned in a width direction of the rectangular second vibration body 52 (y-axis direction in FIGS. 1 and 2) with a spacing therebetween, in a central region of the rectangular second vibration body 52 in the longitudinal direction (x-axis direction in FIG. 1). The exciters 1 are piezoelectric elements, which oscillate upon receipt of an electrical signal, to thereby cause the second vibration body 52 to oscillate.

Each of the exciters 1 is a bimorph piezoelectric element, configured such that one side and the other side in the thickness direction (z-axis direction in FIG. 2) stretch and shrink oppositely, at a given instant upon receipt of an electrical signal. In other words, when one side in the thickness direction stretches the other side shrinks. Accordingly, the exciters 1 each flexurally oscillate upon receipt of an electrical signal.

The exciters 1 each include a multilayer structure composed of four ceramic piezoelectric layers 7 and three inner electrode layers 9 alternately stacked, surface electrode layers 15*a*, 15*b* respectively provided on the upper and lower surfaces of the multilayer structure (end faces in the z-axis direction in FIG. 2), and non-illustrated outer electrodes provided on the respective end faces (lateral faces) of the multilayer structure in the longitudinal direction (x-axis direction in FIG. 1).

The inner electrode layers 9 are alternately drawn out from the respective end faces of the multilayer structure in the longitudinal direction (x-axis direction in FIG. 1), and are respectively connected to the non-illustrated outer electrodes. One of the outer electrodes (not shown) is connected to the surface electrode layers 15*a*, 15*b* and the intermediate one of the inner electrode layers 9, and the other outer electrode (not shown) is connected to the upper and lower inner electrode layers 9. The upper and lower end portions of the other outer electrode (not shown) respectively extend to the upper and lower surfaces of the multilayer structure, thus constituting extensions 19*a*. Each of the extensions 19*a* is spaced from the surface electrode layers 15*a*, 15*b* on the surface of the multilayer structure by a predetermined distance, so as to avoid a contact with the surface electrode layers 15*a*, 15*b*.

Between the two exciters 1, the respective extensions 19*a* on the side opposite to the second vibration body 52 are connected to each other via the lead 22, and the respective surface electrode layers 15*b* are connected to each other via the lead 22*a*. On one of the exciters 1, the extension 19*a* is connected to an end portion of the lead 22*b* and the surface electrode layer 15*b* is connected to an end portion of the lead 22*c*. The other end portions of the lead 22*b* and the lead 22*c* are drawn out to outside. Thus, the pair of exciters 1 are connected in parallel, and the same voltage is applied to the exciters 1 through the leads 22*b*, 22*c*.

The piezoelectric layers 7 are each polarized in the thickness direction (z-axis direction in FIG. 2). The piezoelectric layer 7 may be formed of a known piezoelectric ceramic, such as lead zirconate (PZ), lead zirconate titanate (PZT), or a lead-free piezoelectric material such as a Bi layered compound or a compound having a tungsten-bronze type structure. It is preferable that each of the piezoelectric layers 7 has a thickness of 10 to 100 μm, from the viewpoint of low-voltage driving. In addition, it is preferable that the piezoelectric layer 7 has a d31 piezoelectric coefficient not lower than 180 pm/V, in order to induce a large flexural vibration to thereby increase the acoustic pressure.

It is preferable that the inner electrode layer 9 contains metal components including silver and palladium and material components constituting the piezoelectric layer 7. Employing the ceramic component constituting the piezoelectric layer 7 as a part of the inner electrode layer 9 reduces stress originating from difference in thermal expansion between the piezoelectric layer 7 and the inner electrode layer 9, and thus minimizes defective layer structure in the exciter 1. The conductive material to be contained in the inner electrode layer 9 is not limited to silver and palladium. The ceramic material to be contained in the inner electrode 9 is not limited to those constituting the piezoelectric layer 7, but may be other ceramics. Alternatively, the inner electrode 9 may be free from a ceramic component.

It is preferable that the surface electrode layers 15*a*, 15*b* and the non-illustrated outer electrodes contain a silver-based metal component and a glass component mixed therein. Employing the glass component increases the adhesion between the piezoelectric layer 7 or the inner electrode layer 9 and the surface electrode layers 15*a*, 15*b* or the non-illustrated outer electrodes.

The exciters 1 and the second vibration body 52 are bonded together via an adhesive layer 21. To facilitate the transmission of the vibration of the exciter 1 to the second vibration body 52, it is preferable that the adhesive layer 21 is not thicker than 20 μm, and more preferably not thicker than 10

μm. To form the adhesive layer 21, an adhesive made of a known resin such as an epoxy-based resin, a silicone-based resin, and a polyester-based resin.

The resin layer 20 is filled in the entirety of the inner region of the frame member 5*a*, so as to bury the exciter 1. The lead 22*a* and a part of the lead 22*b* and the lead 22*c* are also buried in the resin layer 20. The resin layer 20 may be formed of a resin such as an acrylic-based resin or a silicone-based resin, or rubber, and preferably the resin layer 20 may have a Young's modulus of 1 MPa to 1 GPa, and more preferably 1 MPa to 850 MPa. In addition, it is preferable that the resin layer 20 has a thickness sufficient to cover the entirety of the exciters 1, from the view point of suppressing spurious. The resin layer 20 also oscillates together with the second vibration body 52.

The load members 41 each have a rectangular sheet shape, and are attached to a central region of the second vibration body 52 via the resin layer 20. In other words, the load members 41 are located in the central region of the second vibration body 52 in the longitudinal direction (x-axis direction in FIG. 1) as well as in the width direction (y-axis direction in FIGS. 1, 2). It is preferable that the load member 41 is soft and easy to deform, such as urethane rubber, in particular a porous rubber such as urethane foam. The load member 41 may be formed in a desired outer shape such as square, rectangular, circular, elliptical, or strip-shape, according to the shape of the region where vibration is to be suppressed. The load member 41 may be formed in an appropriate thickness according to the density of the material constituting the load member 41. It is preferable to make the load member 41 thicker when the density is lower, and thinner when the density is higher. The length and width of the load member 41 may be set, for example, to 10% to 70% of the length and width of the second vibration body 52, and the thickness of the load member 41 may be set to a half to three times of the thickness of the second vibration body 52.

As described above, the vibration device according to this embodiment includes the first frame member 3, the first vibration body 51 provided inside the first frame member 3, the second frame member 5 attached to the first vibration body 51 with a spacing from the first frame member 3, the second vibration body 52 provided inside the second frame member 5 with a spacing from the first vibration body 51, and the exciters 1 attached to the second vibration body 52. Accordingly, the second vibration body 52 can be caused to oscillate by inputting an electrical signal to the exciters 1, and hence the first vibration body 51 connected to the second vibration body 52 via the second frame member 5 can also be caused to oscillate. Therefore, the vibration of the second vibration body 52 generates a sound of a high frequency range with sufficient intensity, and the vibration of the first vibration body 51 generates a sound of a low frequency range with sufficient intensity. Thus, the vibration device configured as above is capable of generating a sound having high acoustic pressure over a wide frequency range.

In addition, since the first vibration body 51 is provided over the entirety of the inner region of the first frame member 3 in the vibration device according to this embodiment, the acoustic pressure of a low frequency sound can be more effectively increased. Likewise, since the second vibration body 52 is provided over the entirety of the inner region of the second frame member 5 in the vibration device according to this embodiment, the vibration of the exciters 1 can be efficiently transmitted to the first vibration body, and the first vibration body can be efficiently caused to oscillate intensely. Further, the vibration device according to this embodiment includes a closed space defined by the first vibration body 51, the second frame member 5, and the second vibration body 52, and therefore the transmission efficiency of the vibration of the exciters 1 to the first vibration body 51 can be further increased, and the vibration intensity of the first vibration body 51 can be further increased. Since the second frame member 5 is located in the central region of the first vibration body 51 in the vibration device according to this embodiment, the vibration can be efficiently transmitted to the first vibration body 51, so as to allow the first vibration body 51 to oscillate intensely and stably.

In the vibration device according to this embodiment, further, the second frame member 5 is formed of a material that is less deformable than the first vibration body 51 and the second vibration body 52. Accordingly, the vibration of the first vibration body 51 and the vibration of the second vibration body 52 can be isolated from each other, and therefore both a sound of a low frequency range and a sound of a high frequency range can be generated with sufficient intensity. Consequently, the vibration device is capable of generating a sound having high acoustic pressure over a wide frequency range.

Further, the second frame member 5 is heavier than the first vibration body 51 and the second vibration body 52 in the vibration device according to this embodiment. Such a configuration also prevents the first vibration body 51 and the second vibration body 52 from collectively oscillating, thereby effectively isolating the vibration of the first vibration body 51 from the vibration of the second vibration body 52.

Still further, the first vibration body 51 is formed of a material that is more deformable than the second vibration body 52 in the vibration device according to this embodiment. Such a configuration enables the vibration device to generate a sound of a low frequency range with increased intensity.

Still further, the first vibration body 51 is formed of a porous rubber in the vibration device according to this embodiment. Therefore, the first vibration body 51 provides both the function to generate a sound of a low frequency range with intensity and the function to reduce an antiphase component of a sound of a high frequency range.

Still further, since the vibration device according to this embodiment includes the load members 41 attached to a part of the second vibration body 52 via the resin layer 20, the amplitude of the portion of the second vibration body 52 where the load members 41 are attached can be suppressed. Therefore, drastic fluctuation of amplitude at a specific frequency can be suppressed. In other words, in the frequency characteristic of the sound generated from the vibration of the second vibration body 52, drastic fluctuation of amplitude at a specific frequency can be prevented, and therefore the vibration device is capable of generating a high-quality sound with reduced distortion.

The overall periphery of the second vibration body 52 is supported by the frame members 5*a*, 5*b* and the load members 41 are attached to the central region of the second vibration body 52, and therefore drastic fluctuation of amplitude can be suppressed at a plurality of frequencies. Attaching thus the load members 41 to the portion where the amplitude becomes maximal at least at a certain frequency allows suppression of the drastic fluctuation of amplitude at that frequency.

Further, the exciters 1 and the load members 41 are alternately aligned in the width direction of the second vibration body 52 of the rectangular shape, in the central region thereof in the longitudinal direction. Therefore, the vibration of the central region in the longitudinal direction can be generally suppressed, and disturbance against the smooth vibration can be prevented, unlike in the case where the exciters 1 and the load members 41 are stacked in the thickness direction of the second vibration body 52.

The vibration device according to this embodiment can be manufactured, for example as described hereunder.

First, a binder, a dispersion agent, a plasticizer, and a solvent are added to powder of a piezoelectric material, and the mixture is stirred so as to make up a slurry. The piezoelectric material may be either a lead based material or a lead-free material. Then the slurry is formed into a sheet shape, thus forming a green sheet. A conductive paste is printed on the green sheet so as to form a conductor pattern, which is to be finished as the inner electrode 9, and a plurality of the green sheets each having the conductor pattern formed thereon are stacked to form a multilayer block.

The multilayer block is then degreased and sintered, and cut into a predetermined size thus to obtain a plurality of multilayer structures. The outer peripheral portion of the multilayer structure is processed if need be. Then a conductive paste is printed on each of the main surfaces of the multilayer structure in the stacking direction so as to form a conductor pattern, which is to be finished as the surface electrode layer 15*a* or 15*b*, and a conductive paste is printed on each of the lateral faces of the multilayer structure in the longitudinal direction (x-axis direction in FIG. 1) so as to form a conductor pattern which is to be finished as the non-illustrated outer electrode. Then upon baking the electrodes at a predetermined temperature, the structure which is to be finished as the exciter 1 can be obtained. To give a piezoelectric property to the exciter 1, a DC voltage is applied through the surface electrode layers 15*a*, 15*b* or the outer electrode (not shown) so as to polarize the piezoelectric layers 7 of the exciter 1. At this point, the first layer and the second layer, and the third layer and the fourth layer of the dielectric layer 7 are polarized in opposite directions to each other. The second layer and the third layer are to be polarized in the same direction. Throughout the foregoing process, the exciter 1 shown in FIG. 1 and FIG. 2 can be obtained.

Then the second vibration body 52 is prepared. The outer peripheral portion of the second vibration body 52 is held between the frame members 5*a*, 5*b* and fixed with a tension applied to the second vibration body 52. An adhesive is applied to one of the surfaces of the second vibration body 52 and the exciters 1 are pressed against the second vibration body 52, and the adhesive is cured by heat or UV irradiation thus to fix the exciters 1. Upon introducing a resin into the inner region of the frame members 5*a* after connecting the leads 20*a*, 20*b*, 20*c* and curing the resin, the resin layer 20 is obtained.

The first vibration body 51 is prepared. The outer peripheral portion of the first vibration body 51 is bonded to the first frame member 3 under a tension applied thereto, thus to be fixed onto the first frame member 3. Then the unified body composed of the second frame member 5, the second vibration body 52, the exciters 1, the leads 20*a*, 20*b*, 20*c*, and the resin layer 20 is bonded to the central region of one of the main surfaces of the first vibration body 51, via the end face of the frame member 5*b* of the second frame member 5. The vibration device according to this embodiment can thus be obtained.

Second Embodiment

Figure 3:
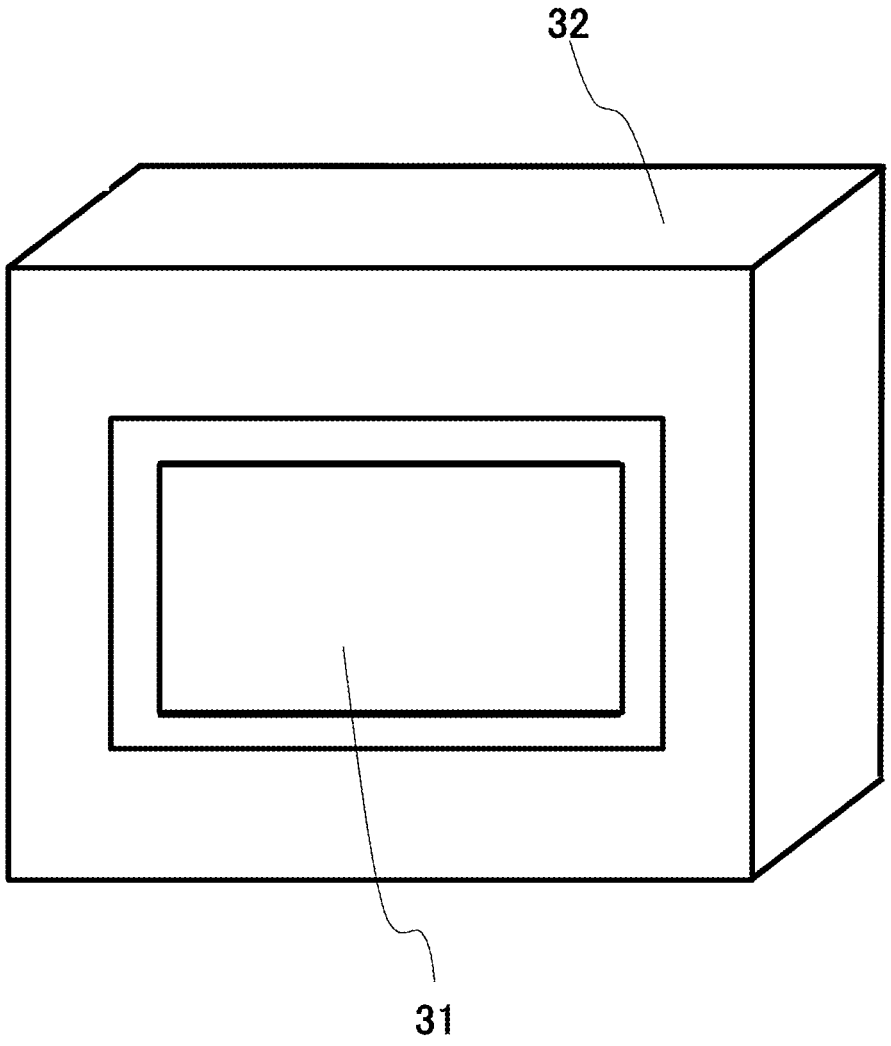
FIG. 3 is a perspective view showing an acoustic generator according to a second embodiment of the present invention.

FIG. 3 is a perspective view showing an acoustic generator according to a second embodiment of the present invention. The acoustic generator according to this embodiment includes a speaker 31 and a housing 32, as shown in FIG. 3.

The speaker 31 is configured to generate a sound including a sound out of the audible frequency band when an electrical signal is inputted and, though details are not shown, includes the vibration device according to the first embodiment of the present invention.

The housing 32 has a rectangular block box shape. The housing 32 includes at least one opening, and the speaker 31 is attached to one of the at least one opening. The housing 32 serves as a support member that supports the speaker 31. The housing 32 also serves to suppress wraparound of an antiphase sound outputted from the rear side of the speaker 31, and to reflect the sound outputted from the speaker 31 inside of the housing 32. The housing 32 may be formed of a material having rigidity sufficient to support the speaker 31, for example wood, a synthetic resin, and a metal.

The acoustic generator according to this embodiment is configured to generate a sound from the speaker 31 that includes the vibration device according to the first embodiment of the present invention, and therefore capable of generating sound having a high acoustic pressure over a wide frequency range.

In addition, since the acoustic generator according to this embodiment includes the housing 32, the acoustic generator can support the speaker 31, and can also improve the quality of the sound compared with the sound generated by the speaker 31 alone.

Third Embodiment

Figure 4:
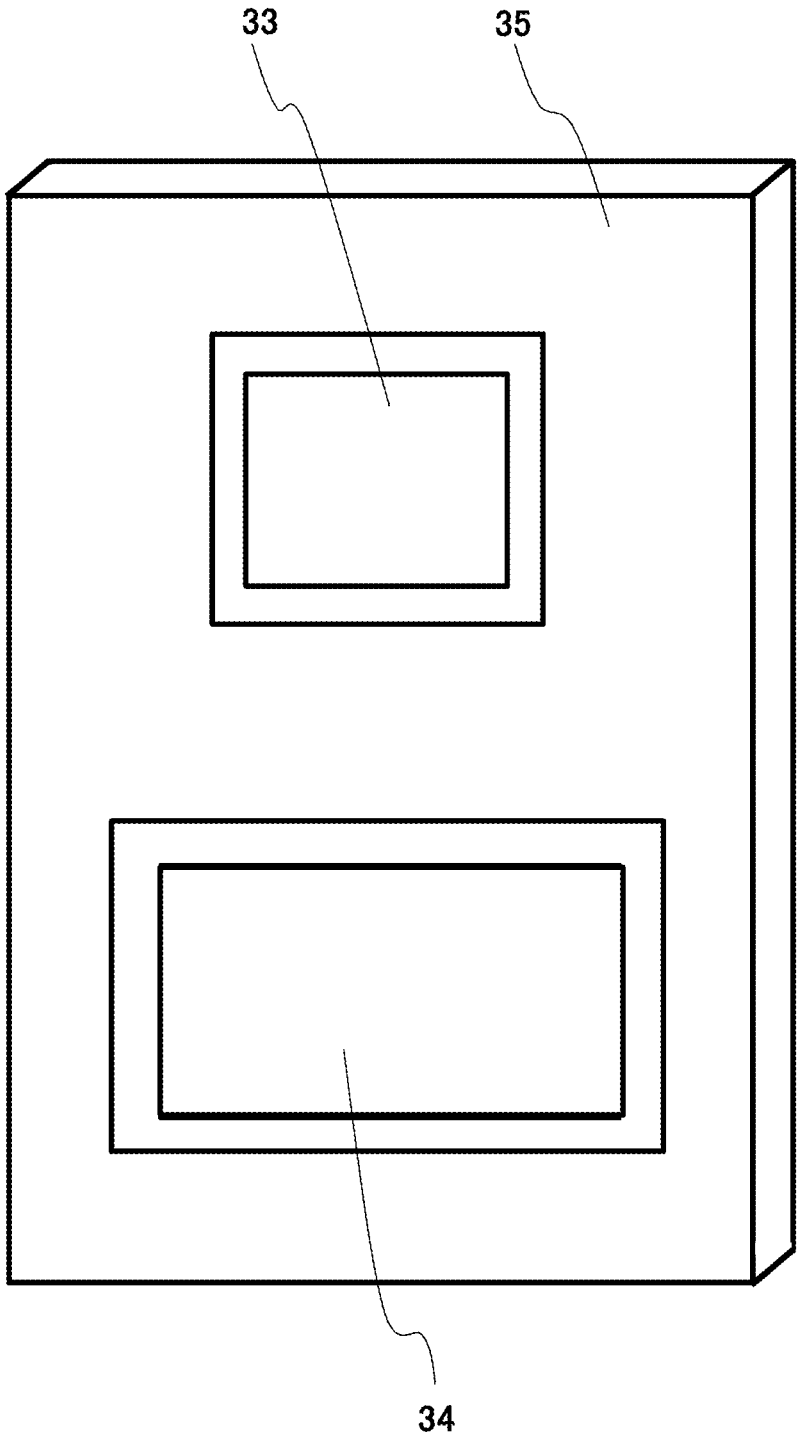
FIG. 4 is a perspective view showing a speaker system according to a third embodiment of the present invention.

FIG. 4 is a schematic perspective view showing a speaker system according to a third embodiment of the present invention. The speaker system according to this embodiment includes, as shown in FIG. 4, at least one high range speaker 33, at least one low range speaker 34, and a support member 35.

The low range speaker 34 is configured to primarily output a low-pitched tone of, for example, a frequency of 20 KHz or lower. The high range speaker 33 is configured to primarily output a high-pitched tone of, for example, a frequency of 20 kHz or higher. The high range speaker 33 is formed in a smaller size than the low range speaker 34 (shorter in longitudinal direction in the case of a rectangular or elliptical shape), to facilitate outputting of a high-frequency sound, but configured similarly to the low range speaker 34 in other aspects. However, the high range speaker 33 may be configured differently from the low range speaker 34. At least one of the high range speaker 33 and the low range speaker 34 includes the vibration device according to the first embodiment of the present invention.

The support member 35 includes a pair of openings, in which the high range speaker 33 and the low range speaker 34 are respectively accommodated and fixed. Thus, the support member 35 serves to support the high range speaker 33 and the low range speaker 34. The support member 35 may be formed of a material having rigidity sufficient to support the high range speaker 33 and the low range speaker 34, for example wood, a synthetic resin, and a metal.

In the speaker system configured as above according to this embodiment, at least one of the high range speaker 33 and the low range speaker 34 includes the vibration device according to the first embodiment of the present invention. Therefore, the speaker system is capable of generating sound having a high acoustic pressure over a wide frequency range.

Fourth Embodiment

Figure 5:
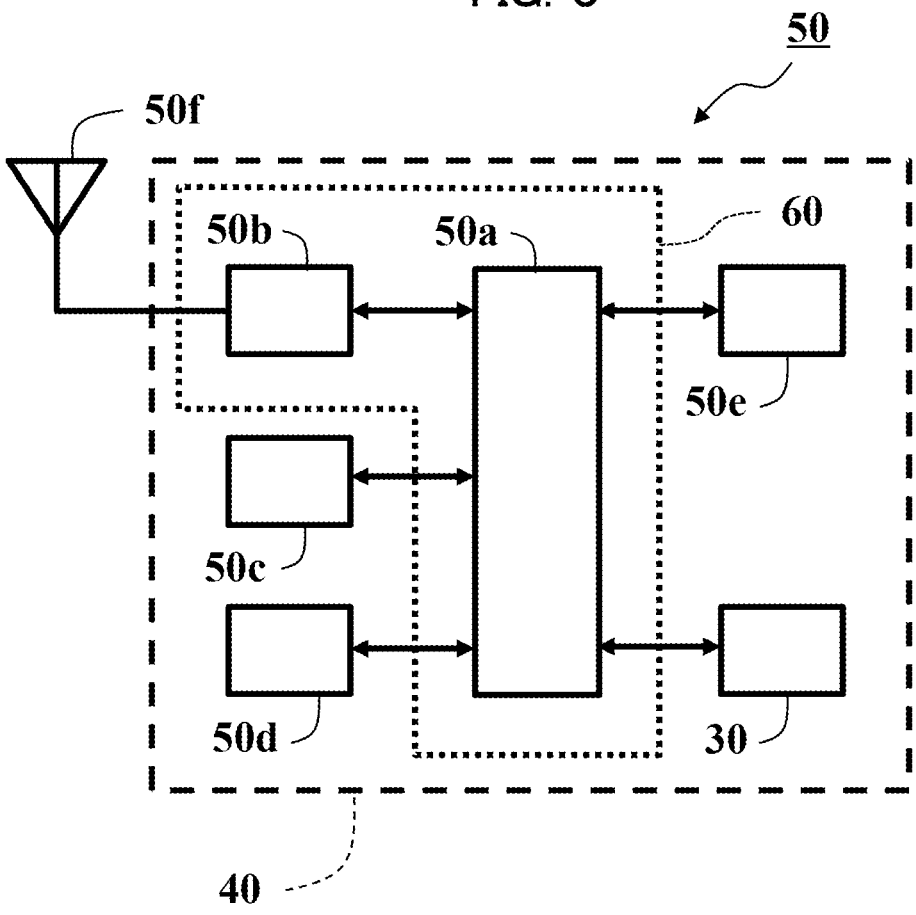
FIG. 5 is a block diagram showing a configuration of an electronic apparatus according to a fourth embodiment of the present invention.

FIG. 5 is a block diagram showing a configuration of an electronic apparatus 50 according to a fourth embodiment of the present invention. The electronic apparatus 50 according to this embodiment includes, as shown in FIG. 5, a speaker 30, a housing 40, an electronic circuit 60, a key input unit 50*c*, a microphone input unit 50*d*, a display unit 50*e*, and an antenna 50*f*.

The electronic circuit 60 includes a control circuit 50*a* and a communication circuit 50*b*. The electronic circuit 60 is connected to the speaker 30 so as to output a sound signal to the speaker. The control circuit 50*a* serves as a control unit of the electronic apparatus 50. The communication circuit 50*b* transmits and receives data through the antenna 50*f*, under the control of the control circuit 50*a*.

The key input unit 50*c* is an input device for the electronic apparatus 50, and accepts an input of an operator made by key operation. The microphone input unit 50*d* is another input device for the electronic apparatus 50, and accepts an input of a verbal message of the operator. The display unit 50*e* serves as the display output device of the electronic apparatus 50, and outputs a display of information under the control of the control circuit 50*a*.

The speaker 30 includes, like the speaker 31, the high range speaker 33, and the low range speaker 34, the vibration device according to the first embodiment of the present invention. The speaker 30 serves as the sound output device of the electronic apparatus 50, and is configured to generate a sound including a sound out of the audible frequency band, according to a sound signal inputted from the electronic circuit 60. Here, the speaker 30 is connected to the control circuit 50*a* of the electronic circuit 60, and generates a sound upon receipt of a voltage controlled by the control circuit 50*a*.

The housing 40 accommodates therein the electronic circuit 60 and so forth for protection. The speaker 30, the key input unit 50*c*, the microphone input unit 50*d*, the display unit 50*e*, and the antenna 50*f* are fixed to the housing 40, and therefore the housing 40 serves as the support member for the speaker 30, the key input unit 50*c*, the microphone input unit 50*d*, the display unit 50*e*, and the antenna 50*f*. Although the speaker 30, the electronic circuit 60, the key input unit 50*c*, the microphone input unit 50*d*, and the display unit 50*e* are accommodated in the housing 40 in FIG. 5, the electronic apparatus 50 may be differently configured. The speaker 30, the electronic circuit 60, the key input unit 50*c*, the microphone input unit 50*d*, and the display unit 50*e* may be exposed in the surface of the electronic apparatus 50. The housing 40 may be formed of a material having a rigidity sufficient to support the speaker 30 and so forth, for example wood, a synthetic resin, and a metal.

The electronic apparatus 50 according to this embodiment is configured to generate a sound by using the speaker 30 that includes the vibration device according to the first embodiment of the present invention, and therefore capable of generating a sound having a high acoustic pressure over a wide frequency range.

Here, it suffices that the electronic apparatus 50 at least includes the speaker 30, the support member that supports the speaker 30, and the electronic circuit 60. It is not mandatory that the electronic apparatus 50 includes all of the speaker 30, the housing 40, the electronic circuit 60, the key input unit 50*c*, the microphone input unit 50*d*, the display unit 50*e*, and the antenna 50*f*. Conversely, the electronic apparatus 50 may include one or more other constituents. The configuration of the electronic circuit 60 is not limited to the above either, but may be configured in a different manner.

The electronic apparatus in which the speaker 30 can be incorporated is not limited to portable terminals such as a mobile phone and a mobile tablet. The speaker 30 including the vibration device according to the first embodiment can be employed as the acoustic generator of various kinds of electronic apparatuses configured to generate a sound. The speaker 30 including the vibration device according to the first embodiment may be employed typically in a flat-panel TV and a car audio system, and also electronic apparatuses configured to generate a sound, such as a vacuum cleaner, a washing machine, a refrigerator, and a microwave oven.

(Variation)

The present invention is in no way limited to the foregoing embodiments, but may be modified or improved in various manners within the scope of the present invention.

For the sake of visual clarity of the drawings, two exciters 1 are mounted on one of the surfaces of the second vibration body 52 in the foregoing embodiments. However, a different configuration may be adopted. For example, a larger number of exciters 1 may be provided on the second vibration body 52.

Although the exciter 1, configured to flexurally oscillate upon receipt of an electrical signal, is mounted on one of the surfaces of the second vibration body 52 in the foregoing embodiments, a different configuration may be adopted. For example, four of exciters 1 configured to flexurally oscillate upon receipt of an electrical signal may be employed. In this case, two of the exciters 1 that constitute a pair may be located on each of the surfaces of the second vibration body 52 so as to hold the second vibration body 52 between the exciter pairs, and the exciters 1 may be configured such that one of the pair of exciters 1 stretches when the other of the pair shrinks, in each of the pairs.

Although one or three load members 41 are provided above the second vibration body 52 via the resin layer 20 in the foregoing embodiments, a different configuration may be adopted. A larger number of load members 41 may be provided, and conversely the load member 41 may be excluded.

Further, although the resin layer 20 is provided to cover the surfaces of the exciters 1 and the second vibration body 52 in the foregoing embodiments, a different configuration may be adopted. The resin layer 20 may be excluded.

Further, although the piezoelectric elements are employed in the exciter 1 in the foregoing embodiments, a different configuration may be adopted. The function expected from the exciter 1 is conversion of an electrical signal into mechanical vibration, and therefore any material capable of converting an electrical signal into mechanical vibration may be employed as the exciter 1. An exciter known to cause a speaker to oscillate, for example an electrokinetic exciter, an electrostatic exciter, or an electromagnetic exciter may be employed as the exciter 1. Here, the electrokinetic exciter is configured to supply a current to a coil located between the respective poles of permanent magnets so as to oscillate the coil. The electrostatic exciter is configured to apply a bias and an electrical signal to a pair of metal plates opposed to each other, so as to cause the metal plates to oscillate. The electromagnetic exciter is configured to provide an electrical signal to a coil so as to cause a thin iron plate to oscillate.

Although the first frame member 3 and the second frame member 5 are formed in a rectangular frame shape in the foregoing embodiments, a different configuration may be adopted. The frame members may be, for example, circular or elliptical. In addition, the first frame member 3 and the second frame member 5 may be different in shape from each other.

Still further, although the first vibration body 51 and the second vibration body 52 are formed of different materials in the foregoing embodiments, a different configuration may be adopted. The first vibration body 51 and the second vibration body 52 may be formed of the same material.

Still further, the first vibration body 51 is provided over the entirety of the inner region of the first frame member 3, and the second vibration body 52 is provided over the entirety of the inner region of the second frame member 5, in the foregoing embodiment. However, a different configuration may be adopted. For example, the second vibration body 52 may be provided only in a part of the inner region of the second frame member 5 (for example, the central region in the x-axis direction in FIG. 1, where the exciters 1 and the load member 41 are located). Likewise, the first vibration body 51 may be provided only in a part of the inner region of the first frame member 3. For example, referring to FIG. 1, the first vibration body 51 may be provided only in the central region of the first frame member 3 in the x-axis direction, where the second frame member 5 and the second vibration body 52 are located. Alternatively, the first vibration body 51 may be formed in a frame shape, and the outer peripheral portion of the frame-shaped vibration body 51 may be fixed to the first frame member 3, and the inner peripheral portion of the frame-shaped vibration body 51 may be fixed to the second frame member 5. In other words, the first vibration body 51 may be excluded from the portion corresponding to the inner region of the second frame member 5.

Working Example

A specific example of the vibration device according to the present invention will be described hereunder. The vibration device according the first embodiment of the present invention, shown in FIG. 1 and FIG. 2, was made up and the performance thereof was evaluated.

First, powder of a piezoelectric material containing lead zirconate titanate (PZT) in which a part of Zr was substituted with Sb, a binder, a dispersion agent, a plasticizer, and a solvent were kneaded in a ball mill for 24 hours, to make up the slurry. From the slurry thus made up, the green sheet was formed by a doctor blade method. A conductive paste containing Ag and Pd was applied to the green sheet in a predetermined pattern by a screen printing method, thus to form a conductor pattern to be finished as the inner electrode layer 9. The green sheets with the conductor pattern formed thereon and other green sheets were stacked and pressurized, to thereby form the multilayer block. The multilayer block was degreased in ambient air at 500° C. for an hour, and then sintered in ambient air at 1100° C. for three hours, thus to obtain the multilayer structure.

Then the end faces of the multilayer structure in the longitudinal direction were cut with a dicing machine, so as to expose the leading end portion of the inner electrode layer 9 in the lateral faces of the multilayer structure. A conductive paste containing Ag and glass was then applied to the both main surfaces of the multilayer structure by a screen printing method, to thereby form the surface electrode layers 15*a*, 15*b* and the electrode layer 19*a*. After that, a conductive paste containing Ag and glass was applied by dipping to the lateral faces of the multilayer structure in the longitudinal direction, and baked in ambient air at 700° C. for ten minutes, to form the outer electrode. Thus, the multilayer structure was finished. The length and width of the main surface of the finished multilayer structure were 46 mm and 18 mm, respectively. The thickness of the multilayer structure was 100 μm. A voltage of 100 V was applied to the multilayer structure for two minutes through the outer electrode for polarization, thus to obtain the exciter 1, made up as a bimorph piezoelectric element.

The first vibration body 51 formed of film-shaped urethane foam having a thickness of 0.5 mm was prepared, and the outer peripheral portion thereof was bonded to the first frame member 3 with an adhesive, with a tension applied to the first vibration body 51, and the adhesive was cured thus to fix the first vibration body 51. The first frame member 3 was made of a stainless steel having a thickness of 0.5 mm. The length and width of the first vibration body 51 inside the first frame member 3 were 130 mm and 100 mm, respectively.

Then the second vibration body 52 formed of a film-shaped polyimide resin having a thickness of 25 μm was prepared, and the outer peripheral portion thereof was bonded between the frame members 5*a*, 5*b* of the second frame member 5 with an adhesive, with a tension applied to the second vibration body 52, and the adhesive was cured thus to fix the second vibration body 52. The frame members 5*a*, 5*b* were both made of a stainless steel having a thickness of 0.5 mm. The length and width of the second vibration body 52 inside the frame members 5*a*, 5*b* were 100 mm and 70 mm, respectively. The exciters 1 were bonded to one of the main surfaces of the second vibration body 52 fixed as above with an adhesive of an acrylic-based resin. The exciters 1 were placed with a spacing of 10 mm therebetween. After that, the leads 2*a*, 2*b*, 2*c* were connected to the exciters 1 to form the wiring. Then an acrylic-based resin, having such a property that the Young's modulus becomes 17 MPa upon being cured, was filled in the inner region of the frame member 5*a* up to the same level as the frame member 5*a*, and then cured so as to form the resin layer 20.

The load member 41 was then bonded to the surface of the resin layer 20 with an adhesive of an acrylic-based resin. Urethane foam of 1 mm in thickness was employed as the load member 41. Then the unified body composed of the second frame member 5, the second vibration body 52, the exciters 1, the leads 20*a*, 20*b*, 20*c*, and the resin layer 20 was bonded to the central region of one of the main surfaces of the first vibration body 51, via the end face of the frame member 5*b* of the second frame member 5. Thus, the vibration device shown in FIG. 1 and FIG. 2 was obtained.

Figure 6:
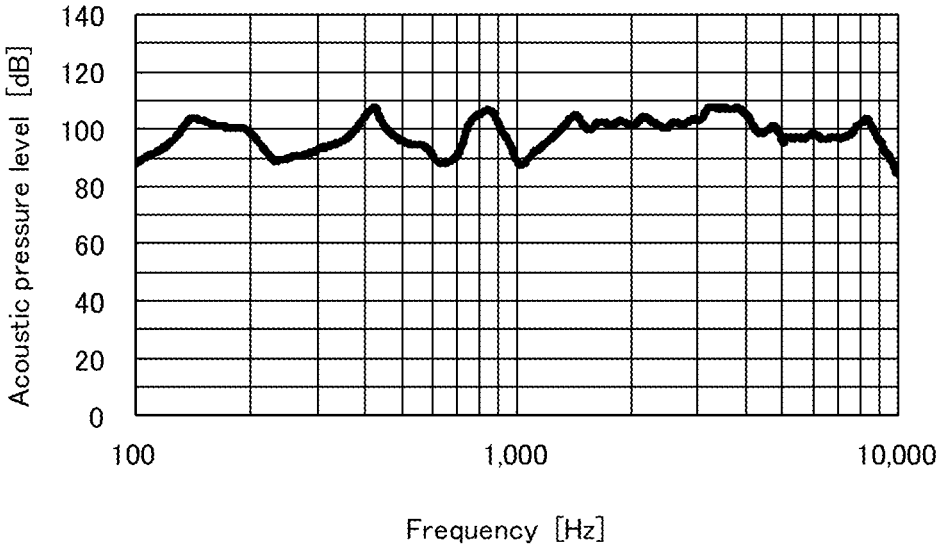
FIG. 6 is a graph showing a frequency characteristic of the acoustic pressure of the sound generated by the vibration device according to the first embodiment of present invention.
Figure 7:
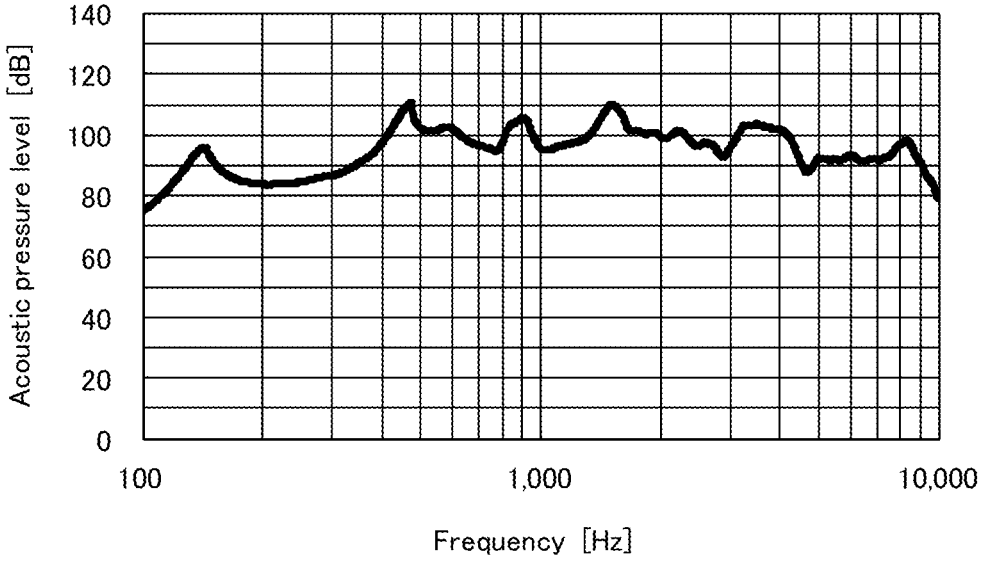
FIG. 7 is a graph showing a frequency characteristic of the acoustic pressure of the sound generated by a vibration device according to a comparative example.

The frequency characteristic of the acoustic pressure of the sound generated by the vibration device made up as above was measured according to EIJARC-8124A specified by Japan Electronics and Information Technology Industries Association (JEITA). In the measurement, a sine wave signal of 5 Vrms was inputted between the leads 22*b* and 22*c* of the vibration device, and the acoustic pressure was measured with a microphone placed at 0.1 m from the vibration device along the reference axis thereof. FIG. 6 shows the measurement result of the sound generated by the vibration device according to the first embodiment of the present invention. FIG. 7 shows the measurement result of the sound generated by a vibration device according to a comparative example, made up without the first frame member 3 and the first vibration body 51. In the graphs shown in FIG. 6 and FIG. 7, the horizontal axis represents the frequency, and the vertical axis represents the acoustic pressure.

Through comparison with FIG. 7 showing the frequency characteristic of the acoustic pressure of the sound generated by the vibration device according to the comparative example, it is understood that the acoustic pressure shown in FIG. 6, showing the frequency characteristic of the sound generated by the vibration device according to the first embodiment of the present invention, is higher especially in a low frequency range in the vicinity of 100 Hz to 300 Hz, and that higher acoustic pressure is achieved over a wider frequency range. This proves the effectiveness of the present invention.

REFERENCE SIGNS LIST

1 Exciter
3 First frame member
5 Second frame member
30, 31 Speaker
32, 40 Housing
33 High range speaker
34 Low range speaker
35 Support member
51 First vibration body
52 Second vibration body
50 Electronic apparatus
60 Electronic circuit

The invention claimed is:

1. A vibration device comprising:
a first frame member;
a first vibration body provided in an inner region of the first frame member;
a second frame member attached to the first vibration body with a spacing from the first frame member;
a second vibration body provided in an inner region of the second frame member with a spacing from the first vibration body; and
an exciter attached to the second vibration body.

2. The vibration device according to claim 1,
wherein the first vibration body is provided over the entirety of the inner region of the first frame member.

3. The vibration device according to claim 1,
wherein the second vibration body is provided over the entirety of the inner region of the second frame member.

4. The vibration device according to claim 1,
wherein the second frame member is formed of a material less deformable than the first vibration body and the second vibration body.

5. The vibration device according to claim 1,
wherein the second frame member is heavier than the first vibration body and the second vibration body.

6. The vibration device according to claim 1,
wherein the first vibration body is formed of a material more deformable than the second vibration body.

7. The vibration device according to claim 1,
wherein the first vibration body is formed of rubber.

8. An acoustic generator comprising:
at least one speaker; and
a support member to which the speaker is attached,
wherein the speaker includes the vibration device according to claim 1.

9. A speaker system comprising:
at least one low range speaker;
at least one high range speaker; and
a support member that supports the low range speaker and the high range speaker,
wherein at least one of the low range speaker and the high range speaker includes the vibration device according to claim 1.

10. An electronic apparatus comprising:
at least one speaker;
a support member to which the speaker is attached; and
an electronic circuit connected to the speaker,
wherein the speaker includes the vibration device according to claim 1,
the electronic apparatus being configured to generate a sound from the speaker.

* * * * *